United States Patent [19]

Miyakawa

[11] Patent Number: 4,462,841

[45] Date of Patent: Jul. 31, 1984

[54] SILVER-METAL OXIDE ALLOY ELECTRICAL CONTACT MATERIALS

[75] Inventor: Yukiei Miyakawa, Susono, Japan

[73] Assignee: Mitsubishi Kinzoku Kabushiki Kaisha, Tokyo, Japan

[21] Appl. No.: 486,509

[22] Filed: Apr. 19, 1983

[30] Foreign Application Priority Data

Apr. 23, 1982 [JP] Japan ..... 57-68475
Apr. 14, 1983 [JP] Japan ..... 58-66124

[51] Int. Cl.[3] ..... C22C 5/08
[52] U.S. Cl. ..... 148/431; 420/504
[58] Field of Search ..... 420/501-504, 420/506; 148/431

[56] References Cited

U.S. PATENT DOCUMENTS

| | | | |
|---|---|---|---|
| 2,486,341 | 10/1949 | Stumbock | 75/232 |
| 2,572,662 | 10/1951 | Richardson | 75/229 |
| 2,796,346 | 6/1957 | Stumbock | 148/431 |
| 3,472,654 | 10/1969 | Comey | 148/431 |
| 3,607,244 | 9/1971 | Kabayama | 148/431 |
| 3,694,197 | 9/1972 | Zdanuk | 470/506 |
| 3,893,820 | 7/1975 | Davies | 148/431 |
| 3,933,485 | 1/1976 | Shibata | 148/431 |
| 4,242,135 | 12/1980 | Shibata | 148/431 |

FOREIGN PATENT DOCUMENTS

| | | | |
|---|---|---|---|
| 1153178 | 8/1963 | Fed. Rep. of Germany . | |
| 2012910 | 3/1970 | Fed. Rep. of Germany . | |
| 2011022 | 3/1970 | Fed. Rep. of Germany . | |
| 52-26468 | 2/1977 | Japan | 420/506 |
| 52-23659 | 2/1977 | Japan | 420/502 |
| 52-33068 | 3/1977 | Japan | 420/506 |
| 53-90132 | 8/1978 | Japan | 148/431 |
| 56-133438 | 10/1981 | Japan | 148/431 |
| 611813 | 11/1948 | United Kingdom . | |
| 456016 | 1/1975 | U.S.S.R. | 420/502 |
| 478346 | 1/1976 | U.S.S.R. | 420/502 |

*Primary Examiner*—L. DeWayne Rutledge
*Assistant Examiner*—Christopher W. Brody
*Attorney, Agent, or Firm*—Frishauf, Holtz, Goodman & Woodward

[57] ABSTRACT

A silver-metal oxides alloy electrical contact material that is highly resistant to sticking and arc-wear is disclosed. The contact material is made by internally oxidizing an alloy consisting essentially of 3-9 wt % Sn, 1-3 wt % In, 0.2-3.0 wt % Cd, 0.05-1 wt % Ni, 0.3-0.8 wt % Cu, the balance being Ag and incidental impurities.

6 Claims, No Drawings

SILVER-METAL OXIDE ALLOY ELECTRICAL CONTACT MATERIALS

TECHNICAL FIELD

The present invention relates to a silver-metal oxide alloy electrical contact material produced by internal oxidation.

BACKGROUND ART

Internally oxidized silver-cadmium oxide has been in wide use as a material for silver-metal oxide alloy electrical contacts, but with recent concern over the potential hazard of cadmium, Ag-$SnO_2$-$In_2O_3$-CdO contacts have come to be used in medium-load breakers. Ag-$SnO_2$-$In_2O_3$-CdO materials are produced by internal oxidation of Ag-Sn-In-Cd alloys, and when used in medium-load breakers, they exhibit more resistance to sticking and wear less than Ag-CdO, and at the same time, their weight is as much as 30% less than that of Ag-CdO, thus making a great contribution to silver saving. But the conventional Ag-$SnO_2$-$In_2O_3$-CdO contact has one serious problem; mud-cracking develops in the contact surface and cause its partial dislodging. Analysis has shown that this defect is caused by arc current that flows through Ag-rich large grain boundaries in the Ag-$SnO_2$-$In_2O_3$-CdO formed as a result of internal oxidation.

DISCLOSURE OF THE INVENTION

The present inventors have now found that copper is very effective in decreasing the Ag-rich grain boundaries that are formed when an Ag-Cd-Sn-In-Ni alloy is internally oxidized. By adding 0.3 to 0.8 wt% of copper to the alloy, the undesired large grain boundaries can be eliminated and a material suitable for making a contact that is more resistant to sticking and wears less than the conventional Ag-$SnO_2$-$In_2O_3$-CdO material is obtained.

Therefore, an object of the present invention is to provide a silver-metal oxide alloy electrical contact material made of an internally oxidized alloy consisting essentially of 3–9 wt% Sn, 1–3 wt% In, 0.2–3.0 wt% Cd, 0.05–1 wt% Ni, 0.3–0.8 wt% Cu, the balance being Ag and incidental impurities. According to the present invention, 0.3 to 0.8 wt% Cu is added to an Ag-Sn-In or Ag-Sn-In-Cd alloy, and an Ag-$SnO_2$-$In_2O_3$ or Ag-$SnO_2$-$In_2O_3$-CdO material which is an internal oxidation product thereof is free from Ag-rich large grain boundaries that lead to surface mud-cracking and hence provides a good material for use in a medium-load breaker that performs well and consistently in actual service.

The criticality of each of the alloy components in the silver base to be internally oxidized will become apparent from the following description wherein all percents are by weight.

Tin (Sn) is included in an amount of 3 to 9%. If its content is less than 3%, the resulting contact material has no adequate ability to interrupt current, and if the contact is more than 9%, the contact resistance is increased and internal oxidation of the alloy becomes difficult.

Indium (In) is included in an amount of 1 to 3%. If its content is less than 1%, it has little effectiveness in promoting the oxidation of tin and the resulting contact material does not have the desired resistance to sticking and arc-wear when used in a medium- or heavy-load breaker. Using more than 3% tin simply results in higher cost.

Cadmium (Cd) content is, preferably, in the range of 0.2 to 0.8%. However, cadmium may also be present in an amount of from more than 0.8 to 3% for the following reason. Thus, finally, the cadmium content is within the range of 0.2–3%.

If its content is less than 0.2%, the castability of the resulting alloy is not good as that of Ag-Cd alloy. On the other hand, if the Cd content is more than 0.8%, it becomes rather difficult to obtain balance between each oxide and in turn it becomes difficult to produce a fine and uniform dispersion of the respective oxides particles. This results in the difficulty in achieving a Vickers hardness of 100 kg/mm$^2$ or more at room temperature. Thus, preferably, the cadmium content should be in the range of 0.2 to 0.8%.

However, later we found that there were some cases in which the presence of more than 0.8% of cadmium seemed to be desired. So, we further studied to examine the effect of incorporating an extended amount of cadmium in the same alloys as discussed above and finally found that Cd could be present in an amount greater than 0.8% but up to 3% without having unacceptably adverse effects on the desired characteristics of the alloy. More specifically, the Cd content can exceed 0.8% without causing substantial defects, and the resulting product still has a Vickers hardness of 100 kg/mm$^2$ or more.

However, if the Cd content exceeds 3%, its toxicity becomes significant and the balance between each oxide is so greatly upset that a uniform and fine dispersion of the respective oxides cannot be obtained. Therefore, for the purposes of the present invention, the Cd content must be within the range of 0.2 to 3% in the sense that preferably it should be in the range of 0.2 to 0.8%, but it can also be in the range of from more than 0.8% to 3%.

Nickel (Ni) is effective in making a fine dispersion of the oxides, particles in the Ag matrix to thereby increase the hardness and arc-wear resistance of the product. If the Ni content is less than 0.05%, a Vickers hardness of 100 kg/mm$^2$ or more is difficult to achieve, and if the content exceeds 1%, a uniform dispersion of the oxides, particles in the Ag matrix cannot be obtained.

Copper (Cu) is essential for decreasing the Ag-rich large grain boundaries arising from the internal oxidation and is incorporated in an amount of 0.3 to 0.8%. If its content is less than 0.3%, crystallization at grain boundaries during internal oxidation is not suppressed, and if the content exceeds 0.8%, more copper dissolves in the Ag matrix to undesirably increase the electrical resistance of the product. For providing the best characteristics, copper is included in an amount of from 0.4 to 0.6%.

The present invention is now described in greater detail by reference to the following examples and comparative examples.

EXAMPLE 1

A mixture of 863 g of Ag and 2 g of Ni was melted at about 1500° C. in the atmosphere. After cooling the melt to 1200° C., 5 g of Cu was added, and after further cooling to 1000° C., 10 g of an Ag-Cd (50:50) base alloy, 30 g of In and 90 g of Sn were added. The entire melt was cast into an ingot weighing 990 g (casting yield: 99%). About 5% of the head of the ingot was cut off and the surface of the remainder was ground into two contact materials 40 mm wide and 10 mm thick. A pure silver sheet about 1 mm thick was bonded to one surface of each material by thermal compression to thereby form a soldering silver layer. The two contact materials were plastically worked into two sheets, one having a thickness of 1.5 mm and the other 1.2 mm thick. They were pressed into round contacts, one for use as a movable contact having a diameter of 6 mm and the other for use as a stationary contact with a diameter of 6.2 mm. The contacts were held in an oxygen atmosphere (700° C., 3 atm.) for 48 hours. The movable contact measured 6 mm in diameter and 1.5 mm in thickness with a curved (R: 20 mm) contact face, and the stationary contact was 6.2 mm in diameter and 1.2 mm thick, with a flat contact face.

EXAMPLE 2

A mixture of 874.5 g of Ag and 0.5 g of Ni was melted at about 1500° C. in the atmosphere. After cooling the melt to 1200° C., 5 g of Cu was added, and after further cooling to 1000° C., 10 g of an Ag-Cd (50:50) base alloy, 30 g of In and 80 g of Sn were added. The molten mix was cast into 990 g of an ingot (casting yield: 99%). Silver-metal oxide alloy contacts of the same shape and size as those of the contacts of Example 1 were prepared by repeating the procedure of Example 1.

EXAMPLE 3

A mixture of 889 g of Ag and 2 g of Ni was melted at about 1500° C. in the atmosphere. After cooling the melt to 1200° C., 3 g of Cu was added, and after further cooling to 1000° C., 16 g of a 50% Ag-50% Cd base alloy, 20 g of In and 70 g of Sn were added. The molten mix was cast into an ingot weighing 990 g (casting yield: 99%). Silver-metal oxide alloy contacts of the same shape and size as those of the contacts of Example 1 were prepared by repeating the procedure of Example 1.

EXAMPLE 4

A mixture of 901 g of Ag and 2 g of Ni was melted at about 1500° C. in the atmosphere. After cooling the melt to 1200° C., 8 g of Cu was added, and after further cooling to 1000° C., 4 g of a 50% Ag-50% Cd base alloy, 20 g of In and 65 g of Sn were added. The molten mix was cast into an ingot weighing 990 g (casting yeild: 99%). Silver-metal oxide alloy contacts of the same shape and size as those of the contacts of Example 1 were prepared by repeating the procedure of Example 1.

EXAMPLE 5

A mixture of 951 g of Ag and 2 g of Ni was melted at about 1500° C. in the atmosphere. After cooling the melt to 1200° C., 3 g of Cu was added, and after further cooling to 1000° C., 4 g of a 50% Ag-50% Cd base alloy, 10 g of In and 30 g of Sn were added. The molten mix was cast into an ingot weighing 990 g (casting yield: 99%). Silver-metal oxide alloy contacts of the same shape and size as those of the contacts of Example 1 were prepared by repeating the procedure of Example 1.

EXAMPLE 6

A mixture of 893 g of Ag and 2 g of Ni was melted at about 1500° C. in the atmosphere. After cooling the melt to 1200° C., 5 g of Cu was added, and after further cooling to 1000° C., 30 g of a 50% Ag-50% Cd base alloy, 30 g of In and 50 g of Sn were added. The molten mix was cast into an ingot weighing 990 g (casting yield: 99%). Silver-metal oxide alloy contacts of the same shape and size as those of the contacts of Example 1 were prepared by repeating the procedure of Example 1.

EXAMPLE 7

A mixture of 888 g of Ag and 2 g of Ni was melted at about 1500° C. in the atmosphere. After cooling the melt to 1200° C., 5 g of Cu was added, and after further cooling to 1000° C., 60 g of a 50% Ag-50% Cd base alloy, 15 g of In and 30 g of Sn were added. The molten mix was cast into an ingot weighing 990 g (casting yield: 99%). Silver-metal oxide alloy contacts of the same shape and size as those of the contacts of Example 1 were prepared by repeating the procedure of Example 1.

EXAMPLE 8

A mixture of 880 g of Ag and 2 g of Ni was melted at about 1500° C. in the atmosphere. After cooling the melt to 1200° C., 5 g of Cu was added, and after further cooling to 1000° C., 18 g of a 50% Ag-50% Cd base alloy, 25 g of In and 70 g of Sn were added. The molten mix was cast into an ingot weighing 990 g (casting yield: 99%). Silver-metal oxide alloy contacts of the same shape and size as those of the contacts of Example 1 were prepared by repeating the procedure of Example 1.

COMPARATIVE EXAMPLE 1

A sample of the conventional Ag-$SnO_2$-$In_2O_3$ contact material was prepared in the following manner. A mixture of 931 g of Ag and 2 g of Ni was melted at about 1500° C. in the atmosphere. After cooling the melt to 1000° C., 17 g of In and 50 g of Sn were added, and the resulting mix was cast into an ingot weighing 900 g (casting yield: 90%). Silver-metal oxide alloy contacts of the same shape and size as those of the contacts of Example 1 were prepared by repeating the procedure of that Example.

COMPARATIVE EXAMPLE 2

Another sample of the conventional Ag-$SnO_2$-$In_2O_3$ contact material was prepared as follows. A mixture of 898 g of Ag and 2 g of Ni was melted at about 1500° C. in the atmosphere. After cooling the melt to 1000° C., 30 g of In and 70 g of Sn were added, and the resulting mix was cast into an ingot weighing 900 g (casting yield: 90%). Silver-metal oxide alloy contacts of the same shape and size as those of the contacts of Example 1 were prepared by repeating the procedure of that Example.

COMPARATIVE EXAMPLE 3

A third sample of the conventional Ag-$SnO_2$-$In_2O_3$ contact material was prepared by the following method. A mixture of 898 g of Ag and 2 g of Ni was melted at about 1500° C. in the atmosphere. After cooling the melt to 1000° C., 10 g of a 50% Ag-50% Cd base alloy, 25 g of In and 65 g of Sn were added. The resulting mix was cast into an ingot weighing 990 g (casting yield: 99%). Silver-metal oxide alloy contacts of the same shape and size as those of the contacts of Example 1 were prepared by repeating the procedure of that Example.

COMPARATIVE EXAMPLE 4

A fourth sample of the conventional Ag-$SnO_2$-$In_2O_3$ contact material was prepared in the following manner. A mixture of 862 g of Ag and 2 g of Ni was melted at about 1500° C. in the atmosphere. After cooling the melt to 1000° C., 16 g of a 50% Ag-50% Cd base alloy, 30 g of In and 90 g of Sn were added, and the resulting mix was cast into an ingot weighing 990 g (casting yield: 99%). Silver-metal oxide alloy contacts of the same shape and size as those of the contacts of Example 1 were prepared by repeating the procedure of that Example.

COMPARATIVE EXAMPLE 5

A sample of the conventional Ag-CdO contact material was prepared in the following manner. A mixture of 758 g of Ag and 2 g of Ni was melted at about 1500° C. in the atmosphere. After cooling the melt to 1000° C., 240 g of a 50% Ag-50% Cd base alloy was added, and the resulting mix was cast into an ingot weighing 990 g (casting yield: 99%). Silver-metal oxide alloy contacts of the same shape and size as those of the contacts of Example 1 were prepared as in that Example.

The compositions of the contact materials prepared in Examples 1 to 8 and Comparative Examples 1 to 5 are listed in Table 1 below.

TABLE 1

| Run No. | Composition (%) | | | | | |
|---|---|---|---|---|---|---|
| | Cu | Cd | Sn | In | Ni | Ag |
| Ex. 1 | 0.5 | 0.5 | 9.0 | 3.0 | 0.2 | bal. |
| 2 | 0.5 | 0.5 | 8.0 | 3.0 | 0.05 | bal. |
| 3 | 0.3 | 0.8 | 7.0 | 2.0 | 0.2 | bal. |
| 4 | 0.8 | 0.2 | 6.5 | 2.0 | 0.2 | bal. |
| 5 | 0.3 | 0.2 | 3 0 | 1.0 | 0.2 | bal. |
| 6 | 0.5 | 1.5 | 5.0 | 2.0 | 0.2 | bal. |
| 7 | 0.5 | 3.0 | 3.0 | 1.5 | 0.2 | bal. |
| 8 | 0.5 | 0.9 | 7.0 | 2.5 | 0.2 | bal. |
| Comp. Ex. 1 | — | — | 5.0 | 1.7 | 0.2 | bal. |
| 2 | — | — | 7.0 | 3.0 | 0.2 | bal. |
| 3 | — | 0.5 | 6.5 | 2.5 | 0.2 | bal. |
| 4 | — | 0.8 | 9.0 | 3.0 | 0.2 | bal. |
| 5 | — | 12.0 | — | — | 0.2 | bal. |

PERFORMANCE TEST 1

The contact materials were checked for their hardness at toom temperature and electrical conductivity. The results are shown in Table 2.

TABLE 2

| Run No. | Hardness at room temp. (MVH) ($kg/mm^2$) | | Electrical conductivity (% IACS) |
|---|---|---|---|
| | Range* | Average** | |
| Ex. 1 | 114–126 | 120 | 56–59 |
| 2 | 113–124 | 119 | 57–60 |
| 3 | 112–122 | 117 | 59–62 |
| 4 | 111–120 | 116 | 60–62 |
| 5 | 98–104 | 101 | 67–69 |
| 6 | 102–108 | 105 | 63–65 |
| 7 | 100–106 | 103 | 65–67 |
| 8 | 113–122 | 118 | 57–62 |
| Comp. Ex. 1 | 91–107 | 99 | 57–62 |
| 2 | 98–112 | 105 | 53–57 |
| 3 | 110–119 | 114 | 61–62 |
| 4 | 113–125 | 119 | 57–60 |
| 5 | 63–72 | 68 | 69–70 |

*The range is from minimum to maximum values.
**The average is the mean value of maximum and minimum values.

The table shows that the contact materials of the present invention experienced no substantial drop in electrical conductivity and were a bit harder than the control materials.

PERFORMANCE TEST 2

To check for wear, contact resistance and antisticking property, the contact samples were subjected to 200,000 cycles of switching with a three-phase electromagnetic breaker (power rated at 5.5 KW with a power factor of 0.5) at 200 volts d.c. and 115 amperes. The results are shown in Table 3.

TABLE 3

| Run No. | Wear after 200,000 cycles of switching (mg) | Contact resistance (mΩ) | |
|---|---|---|---|
| | | before testing | after testing |
| Example 1 | 861 | 0.9 | 7.0 |
| 2 | 842 | 0.8 | 6.8 |
| 3 | 894 | 0.8 | 6.8 |
| 4 | 911 | 0.8 | 6.7 |
| 5 | 973 | 0.7 | 7.0 |
| 6 | 938 | 0.7 | 6.7 |
| 7 | 956 | 0.7 | 6.8 |
| 8 | 890 | 0.8 | 6.8 |
| Comp. Ex. 1 | 1,278 | 0.9 | 7.7 |
| 2 | 1,283 | 0.9 | 7.8 |
| 3 | 1,167 | 0.9 | 7.2 |
| 4 | 1,085 | 0.9 | 7.5 |
| 5 | 1,572 | 0.6 | 7.8 |

Apparently, the contacts using the contact materials of the present invention were less than those made from the control materials. The superiority of the contact material of the present invention derives from the following facts: fine particles of CdO, $SnO_2$, $In_2O_3$, NiO and their mixtures are uniformly dispersed in the Ag matrix; these oxides have suitable vapor pressures at elevated temperatures; and copper functions to stabilize the grain boundaries of the contact material.

What is claimed is:

1. A silver-metal oxides alloy electrical contact material made by internally oxidizing an alloy consisting essentially of 3–9% Sn, 1–3% In, 0.2–3% Cd, 0.05–1% Ni, 0.3–0.8% Cu, the balance being Ag and incidental impurities, with the percents being by weight.

2. A silver-metal oxides alloy electrical contact material as defined in claim 1 wherein the copper content is within the range of 0.4 to 0.6% by weight.

3. A silver-metal oxides alloy electrical contact material made by internally oxidizing an alloy consisting essentially of 3–9% Sn, 1–3% In, 0.2–0.8% Cd, 0.05–1% Ni, 0.3–0.8% Cu, the balance being Ag and incidental impurities, with the percents being by weight.

4. A silver-metal oxides alloy electrical contact material as defined in claim 3 wherein the copper content is within the range of 0.4 to 0.6% by weight.

5. A silver-metal oxides alloy electrical contact material made by internally oxidizing an alloy consisting essentially of 3–9% Sn, 1–3% In, from more than 0.8 to 3% Cd, 0.05–1% Ni, 0.3–0.8% Cu, the balance being Ag and incidental impurities, with the percents being by weight.

6. A silver-metal oxides alloy electrical contact material as defined in claim 5 wherein the copper content is within the range of 0.4 to 0.6% by weight.

* * * * *